US008046844B2

(12) United States Patent
Takano et al.

(10) Patent No.: US 8,046,844 B2
(45) Date of Patent: Nov. 1, 2011

(54) TORSO

(75) Inventors: Mariko Takano, Tochigi (JP); Midori Itou, Kanagawa (JP); Saki Kawai, Tokyo (JP)

(73) Assignee: Bandai Co., Ltd., Tokyo (JP)

( * ) Notice: Subject to any disclaimer, the term of this patent is extended or adjusted under 35 U.S.C. 154(b) by 86 days.

(21) Appl. No.: 12/327,935

(22) Filed: Dec. 4, 2008

(65) Prior Publication Data

US 2009/0200344 A1 Aug. 13, 2009

(30) Foreign Application Priority Data

Feb. 13, 2008 (JP) ..... 2008-032093
Jul. 22, 2008 (JP) ..... 2008-189222

(51) Int. Cl.
*D06C 15/00* (2006.01)

(52) U.S. Cl. ..... 2/66; 223/1
(58) Field of Classification Search ..... 223/1, 52, 223/53, 54, 66, 72, 84
See application file for complete search history.

(56) References Cited

U.S. PATENT DOCUMENTS

| | | | | |
|---|---|---|---|---|
| 2,177,836 | A | 10/1939 | Messer et al. | |
| 3,939,604 | A * | 2/1976 | Nishizawa | 446/98 |
| 5,265,779 | A * | 11/1993 | Jiang | 223/68 |
| 6,000,588 | A * | 12/1999 | Kolton et al. | 223/88 |
| 2007/0275632 | A1* | 11/2007 | Barra et al. | 446/73 |
| 2009/0200344 | A1* | 8/2009 | Takano et al. | 223/71 |

FOREIGN PATENT DOCUMENTS

| | | | |
|---|---|---|---|
| CH | 347426 | | 8/1960 |
| DE | 8215870 | U1 | 9/1982 |
| GB | 680856 | A | 10/1952 |
| JP | 52-18692 | U | 2/1977 |
| JP | 54-83549 | A | 7/1979 |
| JP | 55-38914 | U | 3/1980 |
| JP | 61-73394 | U | 5/1986 |
| JP | 63-143394 | U | 9/1988 |

(Continued)

OTHER PUBLICATIONS

Office Action (Japanese Application No. 2008-189222) mailed on Feb. 3, 2009 (Japan).

(Continued)

*Primary Examiner* — Shaun R Hurley
*Assistant Examiner* — Andrew Sutton
(74) *Attorney, Agent, or Firm* — Ditthavong Mori & Steiner; Toshikatsu Imaizumi

(57) ABSTRACT

A torso, around which clothes can be wound, includes a curved incision on the backface. Preferably, an elastic member is provided at least on the periphery of the incision. The torso may also include a first opening on the backface, an elastic member formed to cover the first opening, and a curved incision on the elastic member, where the incision is exposed from the first opening. Preferably, the incision is formed along the longitudinal direction of the first opening. Furthermore, the first opening may include at least two projections formed on its periphery, and the elastic member may include at least two holes formed at positions opposing the projections, respectively. A fixing member may be provided for fixing the elastic member, and the fixing member includes a second opening having the same shape and size as those of the first opening and formed at a position opposing the incision.

16 Claims, 7 Drawing Sheets

FOREIGN PATENT DOCUMENTS

| | | | |
|---|---|---|---|
| JP | 63-160894 | U | 10/1988 |
| JP | 03-27295 | U | 3/1991 |
| JP | 09-276557 | A | 10/1997 |
| JP | 10-314096 | A | 12/1998 |
| JP | 3079725 | U | 6/2001 |
| JP | 2002-358813 | A | 12/2002 |
| JP | 2003-52601 | A | 2/2003 |
| JP | 2006-61239 | A | 3/2006 |

OTHER PUBLICATIONS

European Search Report (EP Application No. 08-25-3260) dated Jan. 16, 2009.

Office Action mailed on Oct. 21, 2008 (Japanese Patent Application No. 2008-189222) (Japan).

A corrected translation of JPO office action dated Oct. 21, 2008.

* cited by examiner

TORSO

CROSS-REFERENCE TO RELATED APPLICATION

The disclosures of Japanese Patent Application Nos. 2008-032093, filed Feb. 13, 2008, and 2008-189222, filed Jul. 22, 2008, including their specification, claims and drawings, are incorporated herein by reference in their entireties.

BACKGROUND OF THE INVENTION

1. Field of the Invention

The present invention relates to a torso for dress-up doll playing with clothes (garments).

2. Description of the Related Art

Generally, in torsos for dress-up doll playing by variously changing clothes (garments), when the same clothes (garments) are replaced to another torso with a different size and shape, the size may be improper to be ill-shaped. When changing clothes using torsos with different sizes and shapes, it is uneconomically necessary to additionally prepare a plurality of clothes (garments).

In order to solve such a problem, a mannequin doll has been proposed in that a concave recess is formed on the back face of the mannequin doll to have a linear slit, and elastic bodies are provided within the recess on its both insides, respectively, to oppose each other (Japanese Unexamined Utility Model Registration Application Publication No. S55-38914, for example). By using such a mannequin doll, a slack cloth portion generated when putting a garment thereon can be pinched into the slit, thereby easily adjusting the size of the garment.

However, in the mannequin doll described in Japanese Unexamined Utility Model Registration Application Publication No. S55-38914, since the slit is linearly formed for pinching clothes thereinto, the pinched clothes are liable to come off, so that the mannequin doll may be cumbersome to be used for adjusting the size of a garment. The elastic bodies provided within the recess on the back face of the mannequin doll are only arranged on the both the insides within the recess, respectively, to oppose each other, so that the pinched cloth is liable to loose, may resulting in simply coming off the slit. The elastic bodies may simply come off both the sides of the recess due to the repetition of again pinching and coming off.

For a mannequin doll capable of displaying garments with long sleeves, any specification that can adjust the garment in size to comply with the size of the mannequin doll has not been proposed yet.

SUMMARY OF THE INVENTION

The present invention has been made in view of the problems described above, so that it is an object of the invention to propose a torso, around which clothes with a plurality of sizes can be securely wound without damaging the clothes. Furthermore, it is another object to propose a torso capable of displaying garments with long sleeves to comply with the size of the doll.

A torso according to the present invention, around the torso clothes can be wound, includes a curved incision formed on the back face of the torso. The torso may further include a linear incision formed on an arm portion of the torso.

Preferably, the torso further includes an elastic member provided at least on the periphery of the incision. Preferably, the torso further includes a first opening formed on the back face of a body portion; an elastic member formed to cover the first opening; and a curved incision formed on the elastic member, and the curved incision is exposed from the first opening. Preferably, the curved incision is formed along the longitudinal direction of the first opening. Furthermore, preferably, the first opening includes at least two projections formed on its periphery, and the elastic member includes at least two holes formed at positions opposing the projections, respectively. The torso may also preferably include a fixing member configured to fix the elastic member, and the fixing member may include a second opening having the same shape and size as those of the first opening and formed at a position opposing the curved incision.

The torso according to the present invention is one, around which clothes can be wound, and since the torso includes the curved incision formed on the back face of the body portion, when clothes are wound around the torso and an end of the clothes are pinched into the incision, the clothes can be securely fixed without damaging the clothes, enabling the clothes to be easily adjusted in size.

Since the linear incisions are formed on the back faces of the arm portions, a mannequin doll wearing garments with long sleeves can be easily represented without taking care for the size of the doll body.

DESCRIPTION OF THE PREFERRED EMBODIMENTS

First Embodiment

Figure 1:
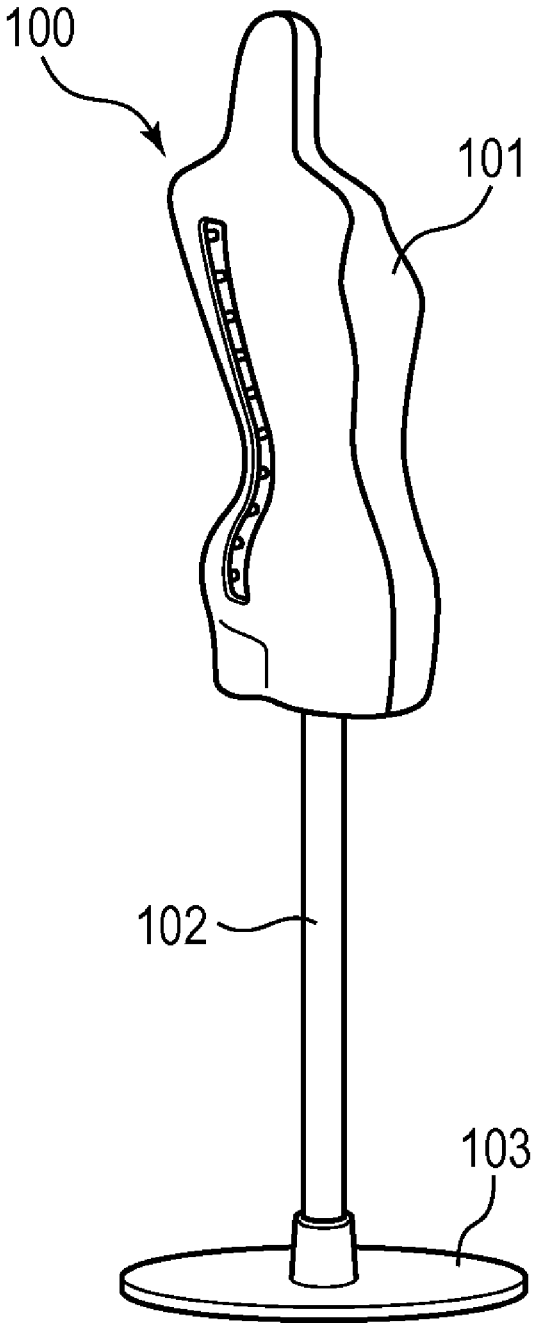
FIG. 1 is an explanatory view illustrating a configuration of a doll body according to the present invention.

FIG. 1 is a perspective view of a torso 100 according to an embodiment of the present invention, showing its external configuration. The torso 100 shown in FIG. 1 includes a body (torso portion) 101, a shaft 102, and a stand 103. Referring to FIG. 1, by fixing one end of the shaft 102 to the body (torso portion) 101 and the other end of the shaft 102 to the stand 103, the body (torso portion) 101 of the torso 100 can be stably supported.

Figure 2:
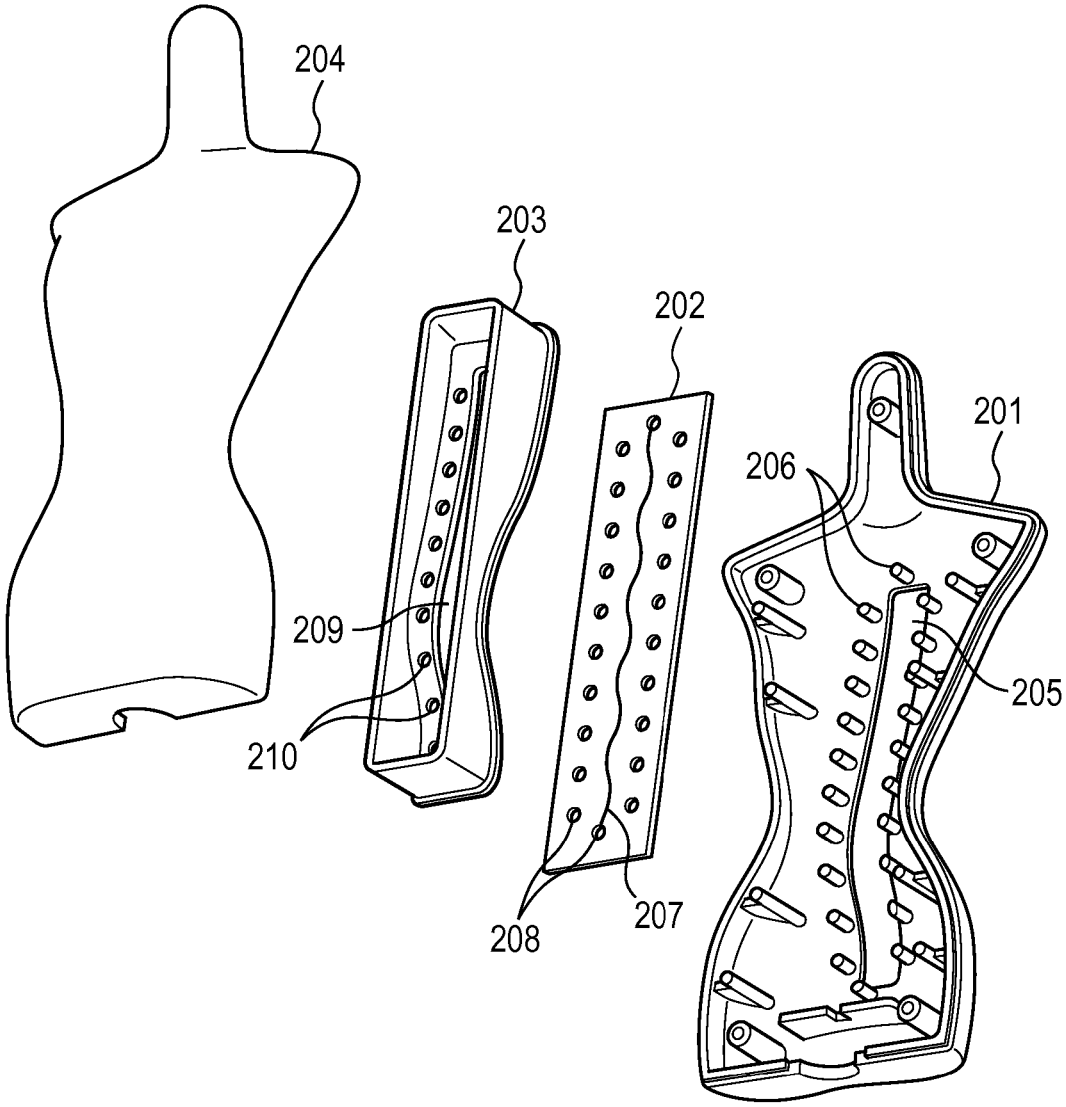
FIG. 2 is an explanatory view illustrating a configuration of the doll body according to the present invention.

FIG. 2 is an exploded schematic view of the body (torso portion) 101 of the torso 100 shown in FIG. 1. According to the embodiment of the present invention, the body (torso portion) 101 includes a backside member 201, an elastic member 202, a fixing member 203, and a front face member 204.

The backside member 201 is a member that corresponds to a back portion of the torso 100 and has a surface curved toward the waist (the area between the ribs and the hips, and narrower than the areas above and below). The backside member 201 is provided with a first opening 205 formed thereon to have a vertically longitudinal opening arranged along with the spine. On the inside (opposing the front face member 204) of the backside member 201, projections 206 are formed around the first opening 205. The number of the projections 206 is not specifically limited; however, it is preferable to be two or more.

The elastic member 202 is provided with a wavy incision 207 formed in the center along a longitudinal direction, and around the incision 207, first holes 208 are formed. The first holes 208 are arranged at positions opposing the projections 206 provided on the backside member 201, respectively, and by fitting the projections 206 into the first holes 208, respectively, the elastic member 202 can be fixed so as to cover the first opening 205 of the backside member 201 from the inside. The elastic member 202 may be made of a silicone resin, for example; however, it is not specifically limited to the silicone resin as long as the material has elasticity.

The fixing member 203 has a second opening 209 formed in the center to have substantially the same shape and size as those of the first opening 205. Around the second opening 209, second holes 210 are formed. The second holes 210 are arranged at positions opposing the first holes 208 of the elastic member 202 and the projections 206 of the backside member 201, respectively, and by fitting the projections 206 into the second holes 210, respectively, the elastic member 202 can be fixed to the backside member 201. The fixing member 203 is not necessarily used herein; however, the use of the fixing member 203 enables the elastic member 202 to be simply fixed to the backside member 201 more rigidly, and also permits the elastic member 202 to be easily replaced to another elastic member by simply removing the fixing member 203 from the backside member 201 even when the force holding the clothes by the incision 207 of the elastic member 202 is reduced.

Figure 3:
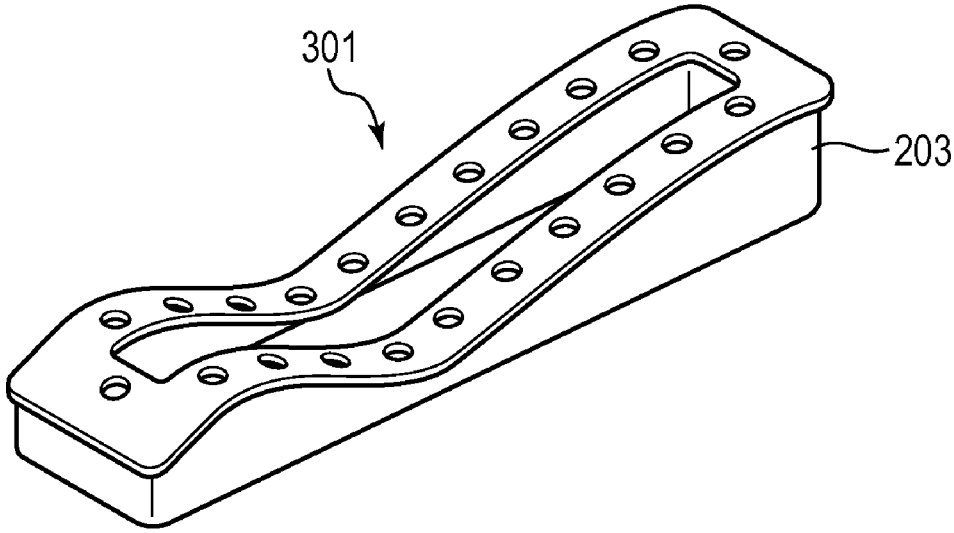
FIG. 3 is an explanatory view illustrating a configuration of a component of the doll body according to the present invention.

The second opening 209 on the fixing member 203 is formed at a position opposing the first opening 205 formed on the backside member 201, and when the fixing member 203 is fitted to the backside member 201, the wavy incision 207 formed on the elastic member 202 is to be arranged in the vicinity of the center of the second opening 209 and the first opening 205, so that the wavy incision 207 is exposed from the first opening 205. The surface 301 of the fixing member 203 to be brought into contact with the elastic member 202, as shown in FIG. 3, is shaped to agree with the shape of the backside member 201. By matching the shape of the fixing member 203 with that of the backside member 201 in such a manner, the elastic member 202 can be fixed more rigidly.

The front face member 204 is a member that corresponds to the chest and the abdomens of the torso, and forms the body (torso portion) 101 by combining the front face member 204 with the backside member 201.

In the torso according to the embodiment of the present invention, since the elastic member 202 is provided with the wavy curved incision 207 formed thereon, when a slack cloth portion generated during winding clothes around the torso (putting a garment thereon) is pinched into the incision 207 of the elastic member 202, the cloth portion cannot come off or drop off the incision 207, enabling the clothes to be securely fixed.

It is preferable that the shape of the incision formed on the elastic member 202 be curved like the wavy incision 207 according to the embodiment. If the shape of the incision is angular like a jigsaw shape or a U-shape turned sideways, the clothes may be possibly damaged when the clothes are pinched into the incision. However, when the shape is curved like a wave profile, clothes cannot be damaged when the clothes are pinched thereinto. If the incision is circular arc-shaped, the circular arc sways only to one side, right or left, along the longitudinal direction of the elastic member 202, so that it is difficult to securely fix the clothes. Accordingly, it is preferable that the incision be shaped in a wavy form that is bilaterally swaying along the longitudinal direction of the elastic member. By forming the incision in such a manner, the region for pinching the clothes (garments) is expanded, enabling the clothes (garments) to be securely fixed. For further securely fixing the clothes, the thickness of the elastic member 202 may also be increased so as to increase the contact area between the elastic member 202 and the clothes in the incision 207 formed on the elastic member 202.

Figure 4:
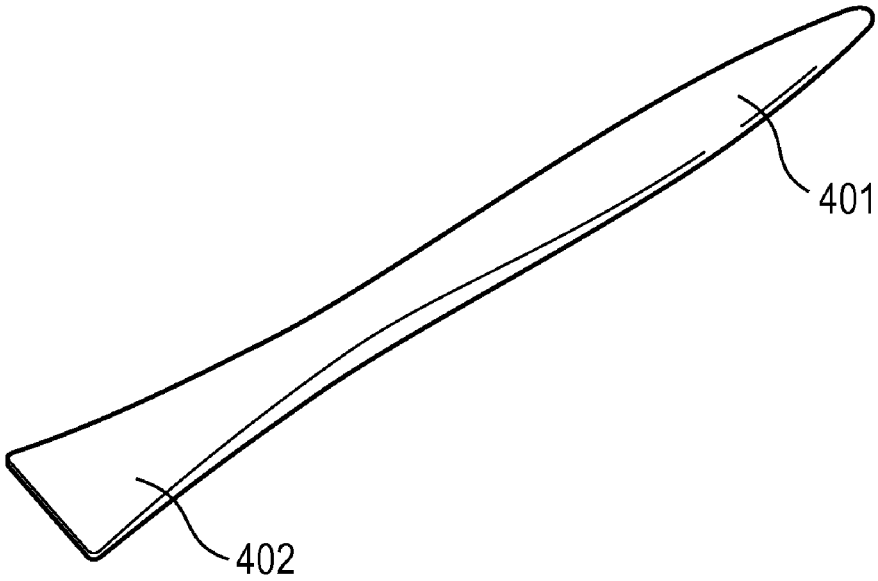
FIG. 4 is an explanatory view illustrating a configuration of a component of the doll body according to the present invention.

When the clothes (garments) are pinched into the incision 207 of the elastic member 202, preferably, a push-in member 401 may be used as shown in FIG. 4. Since an end 402 of the push-in member 401 is acuminate, it is liable to fit into the wavy incision 207, so that a cloth portion slacked during winding the clothes around (during putting garments on) the torso can be pushed in without loosening.

Figure 5A:
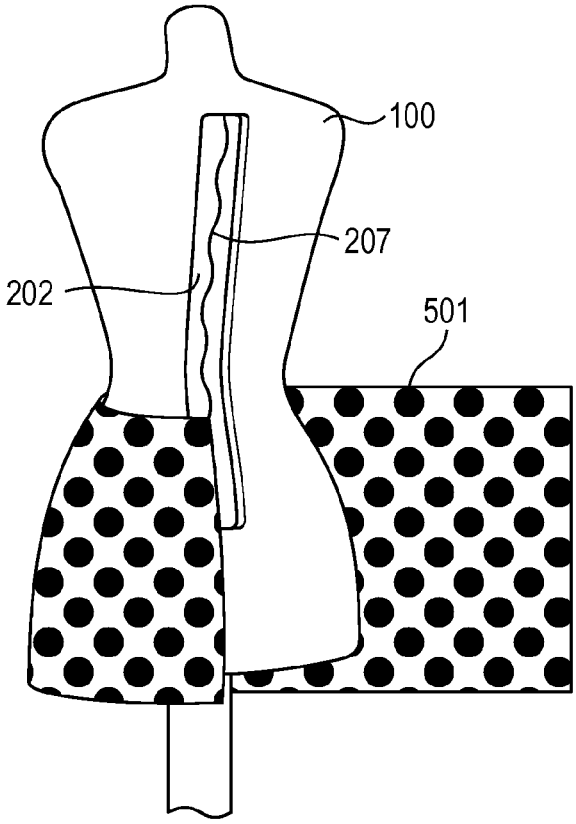
FIGS. 5A and 5B are explanatory views illustrating a usage conformation of the doll body according to the present invention.
Figure 5B:
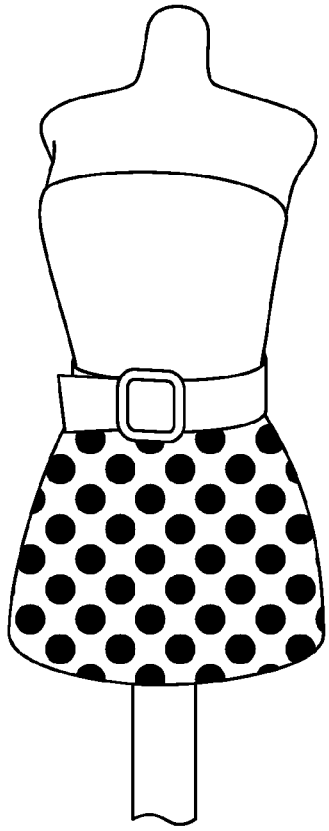

FIGS. 5A and 5B show an example of a usage conformation of the torso 100 according to the embodiment of the present invention. As shown in FIG. 5A, a rectangular cloth 501 is wound around the torso 100, and an end of the cloth 501 is pushed and fixed into the incision 207 formed on the elastic member 202, so that the torso can be displayed in wearing the clothes (garments) fitted to the torso in size (FIG. 5B). According to the embodiment of the present invention, the elastic member 202 is provided with the wavy incision 207 formed thereon, so that clothes can be further securely fixed. Thereby, as shown in FIGS. 5A and 5B, not only ready-made garments but also even when a simple rectangular cloth is pinched, the end of the cloth can be fixed without coming or dropping off the incision 207. Hence, a user can enjoy liking coordinates by combining various cloths without buying ready-made garments, thereby expanding the range of playing to enjoy more amusing plays.

Figure 6:
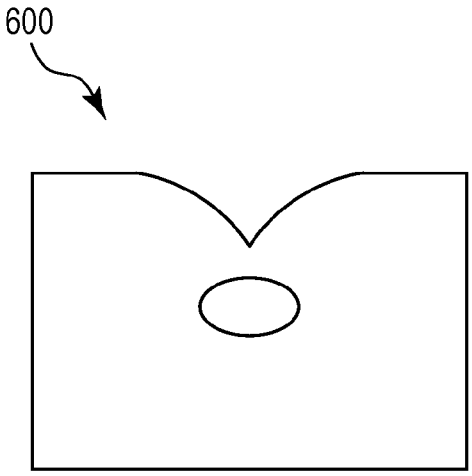
FIG. 6 is an explanatory view illustrating a shape of cloth applicable to the doll body according to the present invention.
Figure 7:
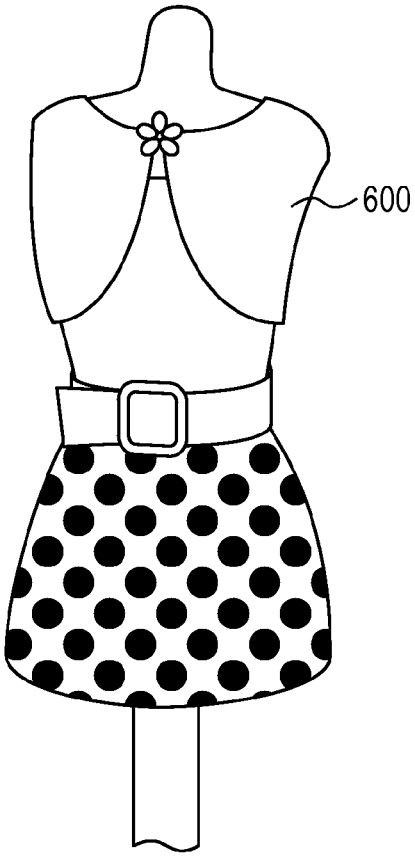
FIG. 7 is an explanatory view illustrating a usage conformation of the doll body according to the present invention.

Various shapes of cloths can be wound around the torso 100, and for example, a cloth 601 shown in FIG. 6 can be used. As shown in FIG. 6, a rectangular cloth is provided with an opening formed for inserting the neck of the body (torso portion) 101 therethrough and cuts curved on the longitudinal side and toward the center of the opening in a bilateral symmetrical arrangement. By winding the cloth around the body (torso portion) 101 with the curved cut portions facing the front, a bolero jacket can be expressed as shown in FIG. 7.

According to the embodiment, the backside member 201 and the elastic member 202 are formed using separate members; alternatively, a torso may be formed of a single member and a curved incision may only be formed on the backside of the torso, or a united member of the backside member 201 and the elastic member 202 may also be used. Furthermore, according to the embodiment of the present invention, the body (torso portion) 101 is formed by combining the backside member 201 with the front face member 204; however, it is not necessarily to combine separate members, so that a united member of the backside member 201 and the front face member 204 may also be used.

As described above, in the torso 100 according to the embodiment of the present invention, the elastic member 202 having the curved incision 207 formed thereon is provided to cover the first opening 205 formed on the backside member 201, so that clothes can be securely fixed without damaging the clothes, enabling clothes to be easily adjusted in size and the play to increase joviality. Since the elastic member 202 is fixed to the backside member 201 by fitting the projections 206 provided around the first opening 205 of the backside member 201 in the torso 100 into the first holes 208 formed on the elastic member 202, respectively, a durable torso can be provided in that the elastic member 202 is more securely fixed.

Second Embodiment

Figure 8:
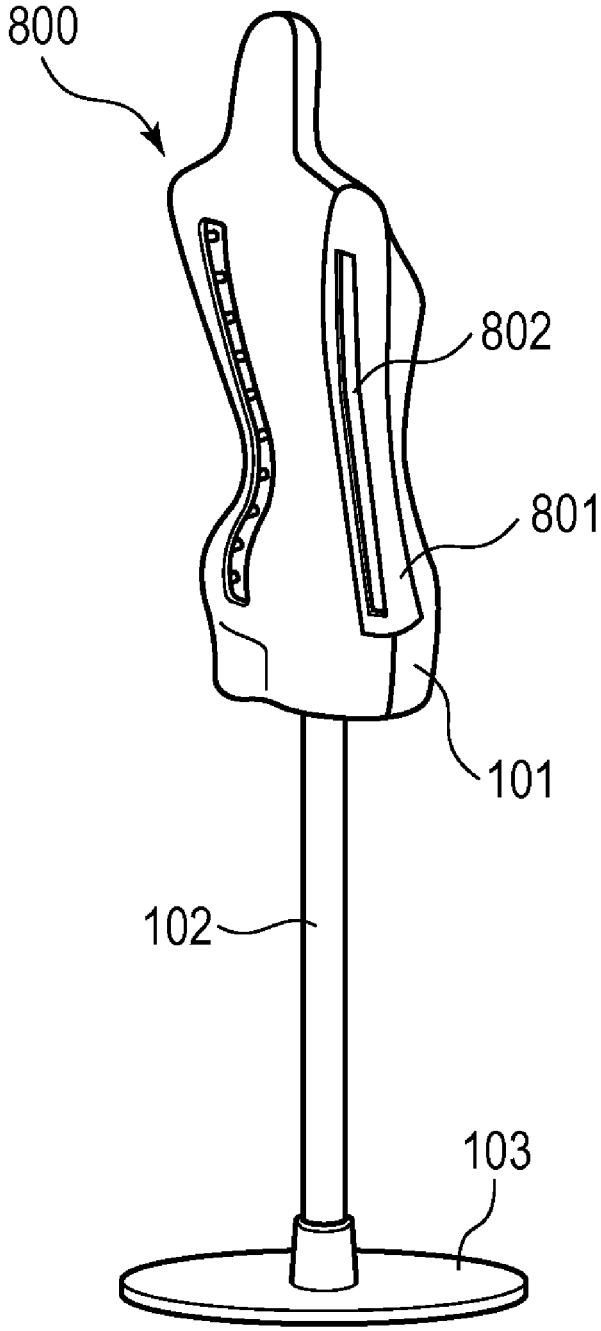
FIG. 8 is an explanatory view illustrating a configuration of a doll body according to the present invention.

FIG. 8 is a perspective view of a torso 800 according to a second embodiment of the present invention, showing its external configuration. The torso 800 shown in FIG. 8 includes the body (torso portion) 101, the shaft 102, and the stand 103. The torso 800 shown in FIG. 8 has a configuration having arm portions 801 with linear incisions 802 formed on the back faces of the arm portions 801 and connected to the body 101 shown in FIG. 1. According to the embodiment, the body 101, the shaft 102, and the stand 103 have the same configurations as those according to the first embodiment, so that the description is omitted.

In the torso according to the embodiment of the present invention, by pinching residual parts of clothes wound around the torso into the curved incision formed on the back side of the body (torso portion) 101 and the linear incisions 802 formed on back sides of the arm portions 801, respectively, a mannequin doll wearing garments with long sleeves can be represented.

Figure 9:
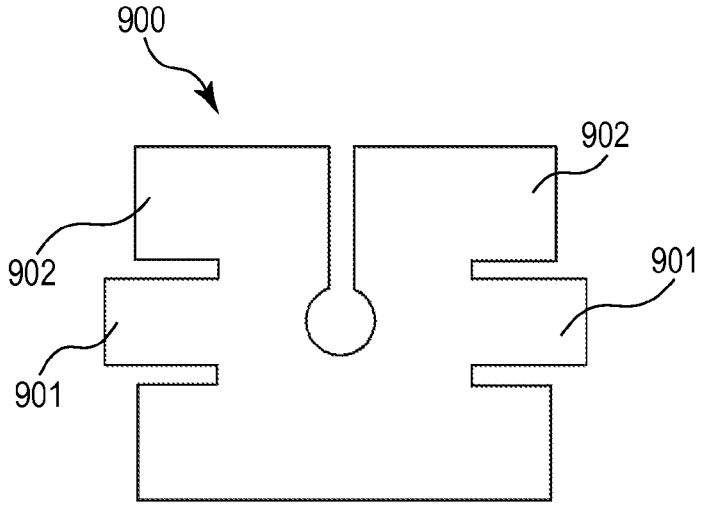
FIG. 9 is an explanatory view illustrating a shape of cloth applicable to the doll body according to the present invention.
Figure 10:
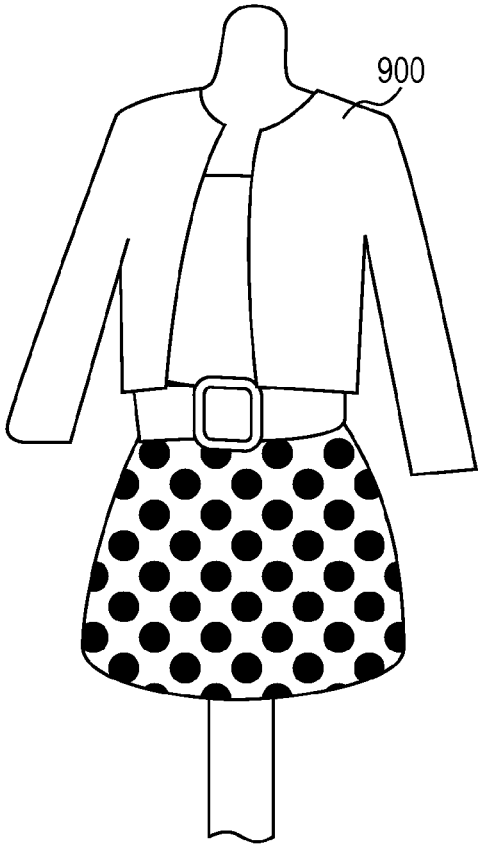
FIG. 10 is an explanatory view illustrating a usage conformation of the doll body according to the present invention.

For example, as shown in FIG. 9, by winding a cloth 900 formed of a first winding part 902 that is to be wound at least around the body (torso portion) 101 and second winding parts 901 that are to be wound around the arm portions 801, respectively, a mannequin doll wearing a cardigan with long sleeves shown in FIG. 10 can be represented. Various shapes of cloth can be wound around the torso 800, so that the shape is not limited to that shown in FIG. 9.

It is preferable that the arm portions 801 be made of a member having elasticity at least on the periphery of the incision.

In the torso 800 according to the embodiment of the present invention, since the linear incisions are formed on the back faces of the arm portions, a mannequin doll wearing garments with long sleeves can be easily represented without taking care for the size of the doll body. Furthermore, since the curved incision is formed on the back side of the torso portion, clothes can be securely fixed without damaging the clothes, enabling the clothes to be easily adjusted in size and the play to increase joviality.

What is claimed is:

1. A form comprising:

an arm portion, and a torso having a top side and a bottom side, around which clothing can be wound, wherein a linear incision is formed on the arm portion, a first opening is formed on a back face of the torso, and an elastic member is formed to cover the first opening, and wherein an undulating incision, which extends in a direction from the tip side to the bottom side, is formed on the elastic member, and the undulating incision is exposed from the first opening.

2. The form according to claim 1, further including clothing wherein the clothing includes a first winding part that is to be wound at least around the body portion and a second winding part that is to be wound around the arm portion.

3. The form according to claim 1, wherein the undulating incision is formed along a longitudinal direction of the first opening.

4. The form according to claim 2, wherein the undulating incision is formed along a longitudinal direction of the first opening.

5. A torso, around which clothing can be wound, comprising:

a first opening formed on a back face of the torso; and an elastic member formed to cover the first opening, wherein a curved and wavy incision is formed on the elastic member, and the curved and wavy incision is exposed from the first opening, wherein the first opening includes at least two projections formed on its periphery, and the elastic member includes at least two holes formed at positions opposing the projections, respectively.

6. A form, around which clothing can be wound, comprising:

a linear incision formed on an arm portion of the form;

a first opening formed on a back face of the form, and an elastic member formed to cover the first opening, wherein a curved and wavy incision is formed on the elastic member, and the curved and wavy incision is exposed from the first opening, and wherein the first opening includes at least two projections formed on its periphery, and the elastic member includes at least two holes formed at positions opposing the projections, respectively.

7. The form according to claim 2, wherein the first opening includes at least two projections formed on its periphery, and the elastic member includes at least two holes formed at positions opposing the projections, respectively.

8. A torso having, a top side and a bottom side, around which clothing can be wound, comprising:

a first opening formed on a back face of the torso; and an elastic member formed to cover the first opening, wherein an undulating incision, which extends in a direction from the top side toward the bottom side of the torso, is formed on the elastic member, and the undulating incision is exposed from the first opening, wherein the undulating incision is formed along a longitudinal direction of the first opening, and wherein the first opening includes at least two projections formed on its periphery, and the elastic member includes at least two holes formed at positions opposing the projections, respectively.

9. The form according to claim 3, wherein the first opening includes at least two projections formed on its periphery, and the elastic member includes at least two holes formed at positions opposing the projections, respectively.

10. The form according to claim 4, wherein the first opening includes at least two projections formed on its periphery, and the elastic member includes at least two holes formed at positions opposing the projections, respectively.

11. The torso according to claim 5, further comprising a fixing member configured to fix the elastic member, wherein the fixing member includes a second opening having the same shape and size as those of the first opening and formed at a position opposing the wavy incision, and a third hole formed on the periphery of the second opening and at positions opposing the projections.

12. The form according to claim 6, further comprising a fixing member configured to fix the elastic member, wherein the fixing member includes a second opening having the same shape and size as those of the first opening and formed at a position opposing the wavy incision, and a third hole formed on the periphery of the second opening and at positions opposing the projections.

13. The form according to claim 7, further comprising a fixing member configured to fix the elastic member, wherein the fixing member includes a second opening having the same shape and size as those of the first opening and formed at a position opposing the undulating incision, and a third hole formed on the periphery of the second opening and at positions opposing the projections.

14. The torso according to claim 8, further comprising a fixing member configured to fix the elastic member, wherein the fixing member includes a second opening having the same shape and size as those of the first opening and formed at a position opposing the undulating incision, and a third hole formed on the periphery of the second opening and at positions opposing the projections.

15. The form according to claim 9, further comprising a fixing member configured to fix the elastic member, wherein the fixing member includes a second opening having the same shape and size as those of the first opening and formed at a position opposing the undulating incision, and a third hole formed on the periphery of the second opening and at positions opposing the projections.

16. The form according to claim 10, further comprising a fixing member configured to fix the elastic member, wherein the fixing member includes a second opening having the same shape and size as those of the first opening and formed at a position opposing the undulating incision, and a third hole formed on the periphery of the second opening and at positions opposing the projections.

* * * * *